US008656529B2

(12) United States Patent
Corriveau et al.

(10) Patent No.: US 8,656,529 B2
(45) Date of Patent: Feb. 25, 2014

(54) PATIENT LIFTING DEVICE

(75) Inventors: Michel Corriveau, Quebec (CA); Martin Faucher, Quebec (CA)

(73) Assignee: Arjohuntleigh Magog Inc., Quebec (CA)

( * ) Notice: Subject to any disclaimer, the term of this patent is extended or adjusted under 35 U.S.C. 154(b) by 0 days.

(21) Appl. No.: 13/577,824

(22) PCT Filed: Feb. 16, 2011

(86) PCT No.: PCT/CA2011/000177

§ 371 (c)(1), (2), (4) Date: Aug. 8, 2012

(87) PCT Pub. No.: WO2011/100824

PCT Pub. Date: Aug. 25, 2011

(65) Prior Publication Data

US 2012/0317715 A1 Dec. 20, 2012

(30) Foreign Application Priority Data

Feb. 18, 2010 (CA) ..... 2693703

(51) Int. Cl.
*A61G 7/10* (2006.01)
*A61G 7/14* (2006.01)

(52) U.S. Cl.
USPC ..... 5/86.1; 5/87.1; 5/83.1

(58) Field of Classification Search
USPC ..... 5/86.1, 81.1 R, 83.1, 87.1
See application file for complete search history.

(56) References Cited

U.S. PATENT DOCUMENTS

| | | | | | |
|---|---|---|---|---|---|
| 686,425 | A | * | 11/1901 | Sommerfeld | 5/86.1 |
| 935,170 | A | * | 9/1909 | Smith | 5/86.1 |
| 2,539,346 | A | * | 1/1951 | Feist | 5/86.1 |
| 2,595,651 | A | * | 5/1952 | Feist | 5/86.1 |
| 2,666,930 | A | * | 1/1954 | Lenahan | 5/86.1 |
| 2,903,238 | A | * | 9/1959 | Flandrick | 254/124 |

(Continued)

FOREIGN PATENT DOCUMENTS

| | | |
|---|---|---|
| CA | 2 273 368 A1 | 11/1999 |
| EP | 0399836 | 11/1990 |

(Continued)

OTHER PUBLICATIONS

International Search Report and Written Opinion for International Patent No. PCT/CA2011/000177, dated May 25, 2011.

(Continued)

*Primary Examiner* — Robert G Santos
(74) *Attorney, Agent, or Firm* — Brinks Gilson & Lione

(57) ABSTRACT

An open base patient lifting machine has generally upwardly extending first and second masts. There is a space between the lower end portion of the second mast. A patient support extends forwardly from the upper portion of the frame. A base at the lower portion of the frame supports the frame. The base has a forwardly extending first leg that is pivotably coupled to the lower end of the first mast about a vertical first axis. An opposed outer end portion of the first leg is positioned forwardly of the first mast. A second leg extends generally forwardly from the second mast. The second leg is pivotably coupled to the lower end portion of second mast about a vertical second axis. A portion of the second leg is positioned forwardly of the second mast. The legs are pivotable about their axes towards and away from each other.

18 Claims, 7 Drawing Sheets

(56) References Cited

U.S. PATENT DOCUMENTS

| | | | | | |
|---|---|---|---|---|---|
| 2,962,730 | A * | 12/1960 | Carnes et al. | 5/86.1 |
| 3,104,399 | A * | 9/1963 | Dalton | 4/562.1 |
| 3,203,009 | A * | 8/1965 | Lundberg | 5/87.1 |
| 3,222,029 | A | 12/1965 | Hidemann | |
| 3,629,880 | A * | 12/1971 | van Rhyn | 5/83.1 |
| 4,545,085 | A * | 10/1985 | Feldt | 5/87.1 |
| 4,644,595 | A | 2/1987 | Daniel | |
| 4,680,819 | A * | 7/1987 | James | 5/83.1 |
| 4,703,523 | A * | 11/1987 | James | 5/83.1 |
| 5,369,821 | A * | 12/1994 | Richards et al. | 5/86.1 |
| 5,412,820 | A * | 5/1995 | Richards | 5/86.1 |
| 5,502,851 | A * | 4/1996 | Costello | 5/86.1 |
| 5,784,729 | A * | 7/1998 | Dunn et al. | 5/86.1 |
| 5,845,348 | A * | 12/1998 | Dunn et al. | 5/83.1 |
| 5,892,180 | A * | 4/1999 | Carey | 177/144 |
| 6,026,523 | A * | 2/2000 | Simon et al. | 5/81.1 R |
| 6,065,162 | A * | 5/2000 | Behr | 5/81.1 R |
| 6,092,247 | A | 7/2000 | Wilson | |
| 6,161,232 | A | 12/2000 | Von Schroeter et al. | |
| 6,175,973 | B1 * | 1/2001 | Hakamiun et al. | 5/89.1 |
| 6,201,195 | B1 * | 3/2001 | Carey | 177/144 |
| 6,289,534 | B1 * | 9/2001 | Hakamiun et al. | 5/89.1 |
| 6,329,612 | B1 * | 12/2001 | von Schroeter | 177/144 |
| 6,367,103 | B1 * | 4/2002 | Collins | 5/86.1 |
| 6,430,761 | B1 * | 8/2002 | Brandorff et al. | 5/86.1 |
| 6,665,894 | B2 * | 12/2003 | Moffa et al. | 5/86.1 |
| 6,742,201 | B2 * | 6/2004 | Porcheron | 5/86.1 |
| 6,806,430 | B2 * | 10/2004 | Downing | 177/144 |
| 6,823,541 | B2 * | 11/2004 | Egan | 5/81.1 R |
| 6,857,144 | B1 * | 2/2005 | Huang | 5/86.1 |
| 7,003,820 | B1 * | 2/2006 | Iura et al. | 5/83.1 |
| 7,007,320 | B2 * | 3/2006 | Ming-Hwa | 5/86.1 |
| 7,360,262 | B2 * | 4/2008 | Mowery | 5/87.1 |
| 7,428,759 | B2 * | 9/2008 | Bain et al. | 5/86.1 |
| 7,437,782 | B1 * | 10/2008 | Burns | 5/87.1 |
| 7,634,824 | B2 * | 12/2009 | Gramkow et al. | 5/81.1 R |
| 7,690,056 | B2 * | 4/2010 | Moffa et al. | 5/84.1 |
| 7,921,485 | B2 * | 4/2011 | Biersteker et al. | 5/83.1 |
| 7,921,486 | B2 * | 4/2011 | Biersteker et al. | 5/87.1 |
| 8,104,115 | B2 * | 1/2012 | Gramkow et al. | 5/83.1 |
| 8,122,534 | B2 * | 2/2012 | Biersteker et al. | 5/86.1 |
| 8,291,529 | B2 * | 10/2012 | Biersteker | 5/83.1 |
| 8,336,133 | B2 * | 12/2012 | Palay et al. | 5/83.1 |
| 8,438,677 | B2 * | 5/2013 | Biersteker | 5/86.1 |
| 8,474,794 | B2 * | 7/2013 | Liljedahl | 254/120 |
| 2002/0069461 | A1 * | 6/2002 | Egan | 5/81.1 R |
| 2002/0153176 | A1 * | 10/2002 | Downing | 177/144 |
| 2003/0110561 | A1 * | 6/2003 | Porcheron | 5/86.1 |
| 2003/0208844 | A1 * | 11/2003 | Moffa et al. | 5/86.1 |
| 2004/0232396 | A1 * | 11/2004 | Ming-Hwa | 254/8 R |
| 2005/0006631 | A1 * | 1/2005 | Ming-Hwa | 254/8 R |
| 2005/0034231 | A1 * | 2/2005 | Huang | 5/86.1 |
| 2005/0210579 | A1 * | 9/2005 | Moffa et al. | 5/81.1 R |
| 2006/0026755 | A1 | 2/2006 | Bain et al. | |
| 2006/0045708 | A1 * | 3/2006 | Bain et al. | 414/620 |
| 2006/0045709 | A1 * | 3/2006 | Bain et al. | 414/626 |
| 2006/0137091 | A1 * | 6/2006 | Gramkow et al. | 5/86.1 |
| 2006/0162069 | A1 * | 7/2006 | Mowery | 5/86.1 |
| 2007/0000049 | A1 | 1/2007 | White et al. | |
| 2008/0189852 | A1 * | 8/2008 | Gramkow et al. | 5/85.1 |
| 2009/0165203 | A1 * | 7/2009 | Biersteker et al. | 5/83.1 |
| 2009/0165204 | A1 * | 7/2009 | Biersteker et al. | 5/87.1 |
| 2009/0249544 | A1 * | 10/2009 | Palay et al. | 5/83.1 |
| 2010/0162483 | A1 * | 7/2010 | Biersteker et al. | 5/87.1 |
| 2010/0224841 | A1 * | 9/2010 | Liljedahl | 254/120 |
| 2011/0289681 | A1 * | 12/2011 | Biersteker | 5/86.1 |
| 2011/0302711 | A1 * | 12/2011 | Biersteker | 5/87.1 |
| 2012/0317715 | A1 * | 12/2012 | Corriveau et al. | 5/86.1 |

FOREIGN PATENT DOCUMENTS

| | | |
|---|---|---|
| EP | 2074978 | 12/2008 |
| WO | WO02074216 A2 | 9/2002 |
| WO | WO 2011/100824 A1 | 8/2011 |

OTHER PUBLICATIONS

International Search Report and Written Opinion for International Patent No. PCT/CA2011/000111, dated May 25, 2011.

* cited by examiner

PATIENT LIFTING DEVICE

CROSS-REFERENCE TO RELATED APPLICATIONS

This application claims benefit of priority from PCT Patent Application PCT/CA2011/000177, filed Feb. 18, 2011, which claims priority from Canadian Patent Application Serial No. 2,693,703, filed on Feb. 19, 2010, each of which is incorporated herein by reference in its entirety.

FIELD

The disclosure relates to patient lifting machines. Specifically, the disclosure relates to patient lifting machines usable to transfer a patient from one place to another.

INTRODUCTION

The following is not an admission that anything discussed below is prior art or part of the common general knowledge of persons skilled in the art.

U.S. Pat. No. 6,092,247 (Wilson) discloses a lift and transfer device. The lift and transfer device includes a wheeled chassis provided with an upright frame. At the lower end thereof, the wheeled chassis connects to a pair of sidewardly spaced and rearwardly cantilevered support legs, which are provided with floor-engaging drive rollers adjacent the rear free ends thereof. A lifting arm arrangement is pivotally supported on the frame adjacent an upper end thereof and is connected to an actuating device to control vertical swinging of the arm arrangement. The arm arrangement is preferably defined by a four-bar linkage, which, at its outer free end, mounts a patient carrier. The latter is vertically moved by the lift arm arrangement in a controlled and stable manner so that its position is stably defined, and the patient carrier permits removable attachment thereto of a patient-engaging sling arrangement to provide stable support of the patient during use of the device for moving or transferring the patient. The support legs are swingable between inner and outer positions whereby the inner position of the legs provides a narrower and more compact arrangement to enable the lift to pass through standard doorways, whereas the outer position provides a flared enlarged opened space to facilitate positioning of a wheelchair or other object between the legs when transfer of a patient is desired.

SUMMARY

The following summary is provided to introduce the reader to the more detailed discussion to follow. The summary is not intended to limit or define the claims.

According to one aspect, an open base patient lifting machine is provided. The open base patient lifting machine comprises a frame comprising a generally upwardly extending first mast and a generally upwardly extending second mast. The frame comprises a lower portion and an opposed upper portion. The first mast and the second mast each comprise a lower end portion at the lower portion of the frame. The lower end portion of the second mast is spaced apart from the lower end portion of the first mast to define a space therebetween. The patient lifting machine further comprises a patient support extending forwardly from the upper portion of the frame. A base is coupled to the lower portion of the frame and supports the frame on a floor. The base comprises a first leg extending generally forwardly from the first mast. The first leg comprises an inner end portion pivotably coupled to the lower end portion of first mast about a generally vertical first axis. The first axis extends through the lower end portion of the first mast. An opposed outer end portion of the first leg is positioned forwardly of the first mast. A second leg extends generally forwardly from the second mast. The second leg comprises an inner end portion pivotably coupled to the lower end portion of second mast about a generally vertical second axis. The second axis extends through the lower end portion of second mast. An opposed outer end portion of the second leg is positioned forwardly of the second mast. The first leg and the second leg are pivotable about the first and second axes, respectively, to move the outer end portions of the first and second legs towards and away from each other.

According to another aspect, another open base patient lifting machine is provided. The open base lifting machine comprises a frame comprising a generally upwardly extending first mast and a generally upwardly extending second mast. The frame comprises a lower portion and an opposed upper portion. The first mast and the second mast each comprising a lower end portion at the lower portion of the frame, and the lower end portion of the second mast is spaced apart from the lower end portion of the first mast to define a space therebetween. A patient support extends forwardly from the upper portion of the frame. A base is coupled to the lower portion of the frame and supports the frame on a floor. The base comprises a first leg extending generally forwardly from first mast. The first leg comprises an inner end portion pivotably coupled to the lower end portion of first mast about a generally vertical first axis, and an opposed outer end portion positioned forwardly of the frame. A second leg extends generally forwardly from the second mast. The second leg comprises an inner end portion pivotably coupled to the lower end portion of second mast about a generally vertical second axis, and an opposed outer end portion positioned forwardly of the frame. The first leg and the second leg are each pivotable about the first and second axes, respectively, to move the outer end portions of the first and second legs towards and away from each other. A first support extends rearwardly of the first mast for engaging the floor rearwardly of the lower end portion of the first mast, and a second support extends rearwardly of the second mast for engaging the floor rearwardly of the lower end portion of the second mast.

According to another aspect, another open base patient lifting machine is provided. The open base lifting machine comprises a frame comprising a generally upwardly extending first mast and a generally upwardly extending second mast. The frame comprises a lower portion and an opposed upper portion. The first mast and the second mast each comprise a lower end portion at the lower portion of the frame, and the lower portion of the second mast is spaced apart from the lower end portion of the first mast to define a space therebetween. A patient support extends forwardly from the upper portion of the frame. A base is coupled to the lower portion of the frame and supports the frame on a floor. The base comprises a first leg extending generally forwardly from the first mast. The first leg comprises an inner end portion pivotably coupled to the lower end portion of first mast about a generally vertical first axis, and an opposed outer end portion positioned forwardly of the first mast. A second leg extending generally forwardly from the second mast. The second leg comprises an inner end portion pivotably coupled to the lower end portion of second mast about a generally vertical second axis, and an opposed outer end portion positioned forwardly of the second mast. The first leg and the second leg are each pivotable about the first and second axes, respectively, to move the outer end portions of the first and second legs towards and away from each other. A first front wheel is mounted to the outer end portion of the first leg, and a second front wheel mounted to the outer end portion of the second leg. The first and second front wheels engage and roll along the floor when the base is pushed forwardly or rearwardly along the floor and when the outer end portions of the first and second legs are moved towards and away from each other.

According to another aspect, another open base patient lifting machine is provided. The open base patient lifting machine comprises a frame comprising a generally upwardly extending first mast and a generally upwardly extending second mast. The frame comprises a lower portion and an opposed upper portion. The first mast and the second mast each comprise a lower end portion at the lower portion of the frame, and the lower end portion of the second mast spaced apart from the lower end portion of the first mast to define a space therebetween. A patient support extends forwardly from the upper portion of the frame. A base is coupled to the lower portion of the frame and supports the frame on a floor. The base comprises a first leg extending generally forwardly from the first mast and comprising an inner end portion pivotably coupled to the lower end portion of first mast about a generally vertical first axis, and an opposed outer end portion positioned forwardly of the first mast. A second leg extends generally forwardly from the second mast. The second leg comprises an inner end portion pivotably coupled to the lower end portion of second mast about a generally vertical second axis, and an opposed outer end portion positioned forwardly of the second mast. The first leg and the second leg are each pivotable about the first and second axes, respectively, to move the outer end portions of the first and second legs towards and away from each other. The open base patient lifting machine further comprises a first actuating assembly and a second actuating assembly for controlling the movement of the first and second legs, respectively. Each actuating assembly comprises an arm mounted to the inner end portion of one of the first leg and the second leg and extending rearwardly therefrom, a worm screw extending generally transversely to the arm, a motor drivingly connected to the worm screw to rotate the worm screw about a longitudinal axis thereof, a bracket mounted to the worm screw and movable along the length thereof in response to rotation of the worm screw, and a connector connecting the bracket to the arm.

According to another aspect, an open base patient lifting machine is provided. The open base patient lifting machine comprises a frame comprising a generally upwardly extending first mast and a generally upwardly extending second mast. The frame comprises a lower portion and an opposed upper portion. The first mast and the second mast each comprise a lower end portion at the lower portion of the frame, and the lower end portion of the second mast spaced apart from the lower end portion of the first mast to define a space therebetween. A boom extends forwardly from the upper portion of the frame. The boom comprises a first end portion coupled to the frame, and an opposed second end portion positioned forwardly of the frame and configured to support a patient sling. The open base patient lifting machine further comprises a lifting assembly having bottom end portion mounted to the frame and a top end portion mounted to the boom. The lifting assembly is aligned centrally between the first mast and the second mast, and is extendible in length to move the second end portion upwardly and downwardly with respect to the frame. The open base patient lifting machine further comprises a base coupled to the lower portion of the frame and supporting the frame on a floor. The base comprises a first leg extending generally forwardly from the first mast. The first leg comprises an inner end portion pivotably coupled to the lower end portion of first mast about a generally vertical first axis, and an opposed outer end portion positioned forwardly of the first mast. A second leg extends generally forwardly from the second mast. The second leg comprises an inner end portion pivotably coupled to the lower end portion of second mast about a generally vertical second axis, and an opposed outer end portion positioned forwardly of the second mast. The first leg and the second leg are pivotable about the first and second axes, respectively, to move the outer end portions of the first and second legs towards and away from each other.

In any of the above aspects, the open base patient lifting machine may comprise a first pivot pin mounted to the lower end portion of the first mast and positioned beneath the lower end portion of the first mast, and a second pivot pin mounted to the lower end portion of the second mast and positioned beneath the lower end portion of the second mast. The inner end portion of the first leg may be received on the first pivot pin and pivotable thereabout, and the inner end portion of the second leg may be received on the second pivot pin and pivotable thereabout.

In any of the above aspects, the open base patient lifting machine may further comprise a first actuating assembly and a second actuating assembly for controlling the movement of the first and second legs, respectively. Each actuating assembly may comprise a motor drivingly connected to the inner end portion of one of the first leg and the second leg.

In any of the above aspects, each actuating assembly may further comprise an arm mounted to the inner end portion of one of the first leg and the second leg and extending rearwardly therefrom. Each actuating assembly may be configured to rotate a respective one of the arms back and forth about a respective one of the first axis and second axis.

In any of the above aspects, each actuating assembly may further comprise a worm screw extending generally transversely to the arm and driven by the motor to rotate the worm screw about a longitudinal axis thereof. A bracket may be mounted to the worm screw and movable along the length thereof in response to rotation of the worm screw. A connector may connect the bracket to the arm.

In any of the above aspects, the first actuating assembly may be positioned rearwardly of the first mast, and the second actuating assembly may be positioned rearwardly of the second mast.

In any of the above aspects, the open base patient lifting machine may further comprise a first support extending rearwardly of the first mast for engaging the floor rearwardly of the lower end portion of the first mast and a second support extending rearwardly of the second mast for engaging the floor rearwardly of the lower end portion of the second mast. The first actuating assembly may be mounted to the first support, and the second actuating assembly may be mounted to the second support.

In any of the above aspects, the first support and second support may each comprise a lower strut extending rearwardly from the lower end portion of one of the first mast and the second mast. The lower strut may have a first end portion adjacent the one of the first mast and the second mast, and an opposed second end portion. The first support and second support may each further comprise an upper strut extending downwardly and rearwardly from the one of the first mast and the second mast at a position above the first end portion of the lower strut. The upper strut may have a first end portion adjacent the one of the first mast and second mast and an opposed second end portion joined to the second end portion of the lower strut. The first support and second support may each further comprise a ground engaging rear wheel mounted to the second end portion of one of the lower strut and the upper strut.

In any of the above aspects, the open base patient lifting machine may further comprise a first casing housing the first actuating assembly and the lower and upper struts of the first support and a second casing housing the second actuating assembly and the lower and upper struts of the second support.

In any of the above aspects, a first front wheel may be mounted to the outer end portion of the first leg, and a second front wheel may be mounted to the outer end portion of the second leg. The first and second front wheels may be configured to engage and roll along the floor when the base is pushed forwardly or rearwardly along the floor and when the outer end portions of the first and second legs are moved towards and away from each other. The first and second front wheels may be casters. The first and second front wheels may be the only ground engaging structures positioned forwardly of the first and second masts.

In any of the above aspects, the first mast and second mast may each comprise an upper end portion at the upper portion of the frame and opposed to the lower end portions thereof. The upper end portions may be joined together.

In any of the above aspects, the space between the lower end portions of the first and second masts may extend from the floor upwardly to a position above the lower end portion of the first mast and the lower end portion of the second mast.

In any of the above aspects, the patient support may comprise a boom comprising a first end portion coupled to the frame, and an opposed second end portion positioned forwardly of the frame and configured to support a patient sling. The second end portion may be moveable upwardly and downwardly with respect to the frame.

In any of the above aspects, the frame may further comprise a cross bar extending between the first mast and the second mast above the lower end portions of the first mast and second mast, and the bottom end portion of the lifting assembly may be mounted to the cross-bar. The top end portion of the lifting assembly may be mounted to the first end portion of the boom. The boom may be pivotably moveable with respect to the frame.

In any of the above aspects, the first axis may extend through the lower end portion of the first mast, and the second axis may extend through the lower end portion of the second mast.

DRAWINGS

Reference is made in the detailed description to the accompanying drawings, in which.

DETAILED DESCRIPTION

Figure 1:
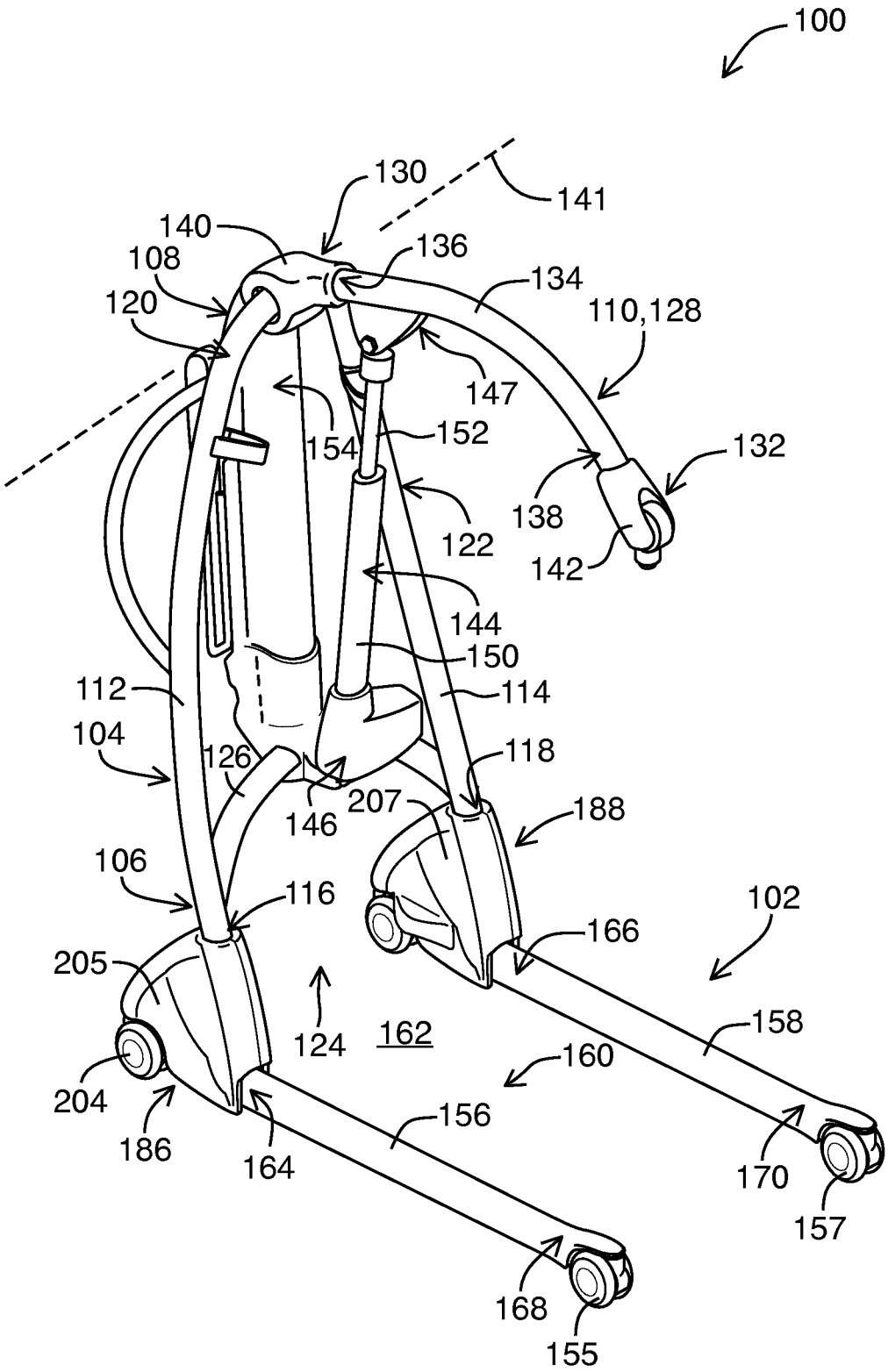
FIG. 1 is a perspective illustration of a patient lifting machine.
Figure 2:
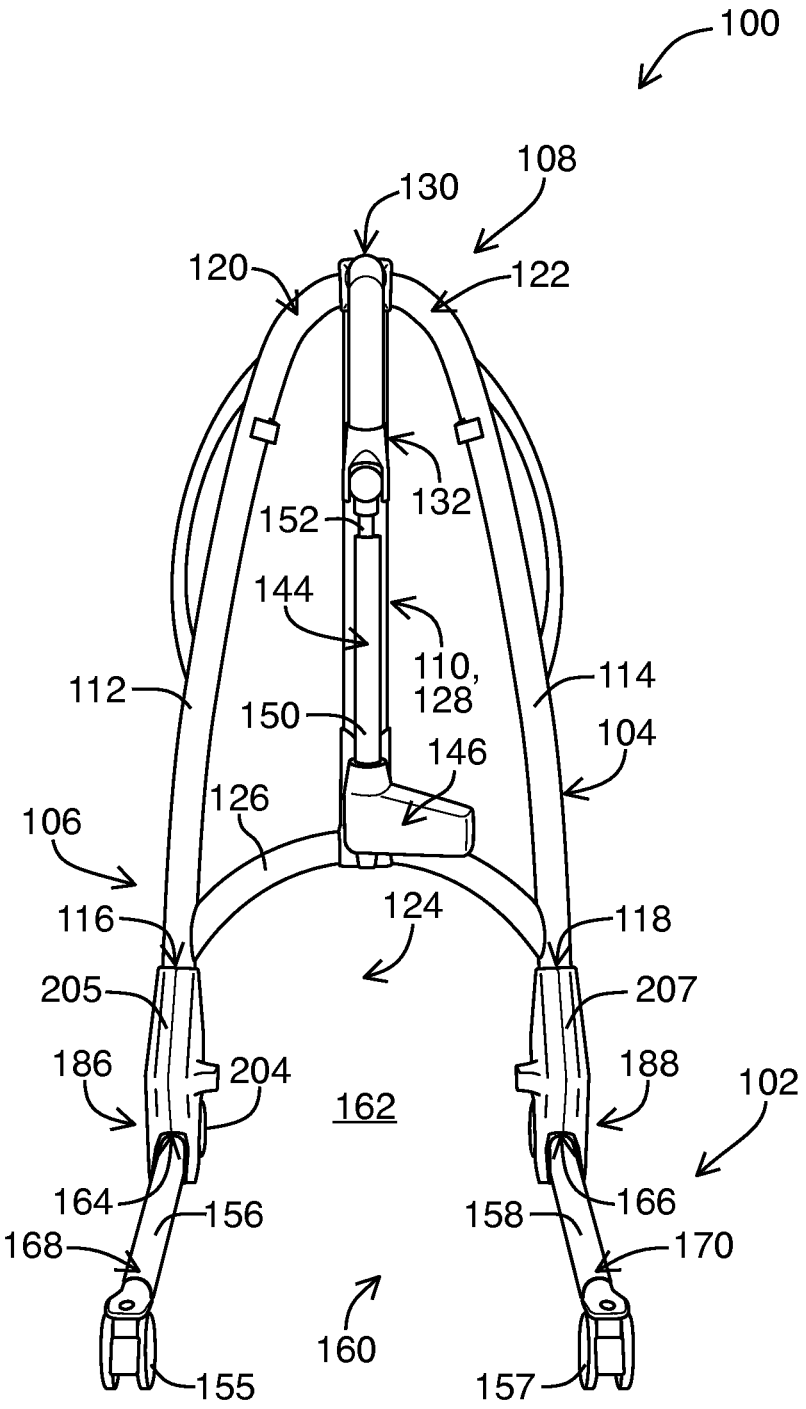
FIG. 2 is a front plan view of the patient lifting machine of FIG. 1.

Referring to FIGS. 1 and 2, an example of a patient lifting machine 100 is shown. The patient lifting machine 100 is usable to transfer or transport a patient, such as a disabled or sick human, from one location to another, such as from a bed to a chair. Particularly, as will be described in further detail below, the patient lifting machine 100 includes a base 102 which is seated on and movable along a surface, such as a floor. The patient lifting machine 100 further includes a frame 104. The frame 104 has a lower portion 106 coupled to the base and an opposed upper portion 108. A patient support 110 extends forwardly from the upper portion 108 of the frame 104. A patient sling (not shown) may be suspended from the patient support 110, for example using a spreader bar, and a patient may be secured in the sling, such that as the base 102 is moved along the floor, the patient is moved.

Referring still to FIGS. 1 and 2, the frame 104 includes a generally upwardly extending first mast 112, and a generally upwardly extending second mast 114. Each of the first mast 112 and the second mast 114 has a lower end portion 116, 118, respectively, at the lower portion 106 of the frame, and an opposed upper end portion 120, 122, respectively, at the upper portion 108 of the frame. The lower end portion 116 of the first mast 112 is spaced apart from the lower end portion 118 of the second mast 114, to define a space 124 therebetween. The space extends from the floor upwardly to a position above the lower end portions 116, 118 of the first mast 112 and second mast 114. The upper end portions 120, 122, respectively are joined together at the upper portion 108 of the frame.

In the example shown, the first mast 112 and second mast 114 are integrally formed from a single steel tube that is bent to form the first mast 112 and second mast 114. In alternate examples, a first mast and second mast may be separately formed, and upper portions thereof may be subsequently joined together, for example by welding or by one or more mechanical connectors. In further alternate examples, upper end portions may not be joined. For example, the upper end portions may be spaced apart.

Referring still to FIG. 1, the frame further includes a cross bar 126 extending between the first mast 112 and the second mast 114, above the lower end portions 116, 118 of the first mast 112 and second mast 114. The cross bar 126 provides mechanical support to the frame 104, and defines the upper end of the space 124.

Referring still to FIG. 1, the patient support 110 includes a boom 128, which has a first end portion 130 coupled to the frame 104, and an opposed second end portion 132 positioned forwardly of the frame 104 and configured to support a patient sling. As will be described in further detail, the boom 128 is pivotably mounted with respect to the frame 104.

The boom includes a bar 134, which has a rearward end portion 136 and a forward end portion 138. The boom further includes mount 140 at the first end portion 130 thereof. The mount 140 is secured to the rearward end portion 136 of the bar 134, and is mounted to the upper end portions 120, 122 of the first mast 112 and second mast 114, to secure the boom 128 to the frame 104. The mount 140 may be secured to the rearward end portion 136 of the bar 134 in any suitable fashion. The mount 140 is rotatably mounted frame 104, at the upper end portions 120, 122 of the first mast 112 and second mast 114, so that the bar 134 may be rotated about a generally horizontal axis 141, in order to raise and lower the second end portion 132 of the boom 128, as will be described herein below.

The boom further includes coupling 142 at the second end portion 132 thereof. The coupling 142 is secured to the forward end portion 138 of the bar 134. The coupling 142 is configured to have a patient sling suspended therefrom, for example using a spreader bar, so that a patient may be suspended from the second end portion 132 of the boom.

In alternate examples, the patient support 110 may include another type of support other than a boom. For example, the patient support may include a chassis.

Referring still to FIG. 1, as mentioned hereinabove, the second end portion 132 of the boom 128 is moveable upwardly and downwardly with respect to the frame 104, to raise and lower a patient secured in the patient sling. Particularly, the patient lifting machine 100 includes a lifting assembly 144. The lifting assembly 144 has a bottom end portion 146 mounted to the frame 104, and specifically, to the cross bar 126. The lifting assembly 144 further has a top end portion 147 mounted to the first end portion 130 of the boom 128, and specifically, to the bar 134. As can be seen in FIG. 2, the lifting assembly 144 is aligned generally centrally between the first mast 112 and second mast 114. The lifting assembly 144 is extendible in length to move the second end portion 132 of the boom upwardly and downwardly with respect to the frame. Specifically, the lifting assembly includes a lower cylinder 150, and an upper cylinder 152, which is received in the lower cylinder 150, and moveable in and out of the lower cylinder 150. By moving the upper cylinder 152 out of the lower cylinder 150, the length of the lifting assembly 144 is extended, and the bar 134 is pushed upwardly and rotated about the axis 141, to raise the second end portion 132 of the boom 128 and a patient sling suspended therefrom.

The upper cylinder 152 may be moved with respect to the lower cylinder 150 in any suitable manner. In the example shown, the lower cylinder 150 and upper cylinder 152 are secured together by mating screw threads (not shown), such that by rotating the lower cylinder 150, the upper cylinder 152 is pushed upwardly. A power assembly 154 is provided to power the rotation of the lower cylinder 150. The power assembly 154 may, for example, include a battery. In alternate examples, the upper cylinder 152 may be moved in another manner, such as pneumatically or hydraulically.

In alternate examples, the second end portion 132 of the boom 128 may be moveable in another manner, and another type of lifting assembly 144 may be provided. For example, rather than rotating the boom 128 about the axis 141, the entire boom 128 may be raised and lowered. For example, the frame 104 may be telescopic, so that its height may be increased to raise and lower the boom 128. In such examples, the frame 104 itself may be the lifting assembly.

Referring still to FIGS. 1 and 2, the base 102 is coupled to the lower end portion 106 of the frame 104, and supports the frame 104 on the floor (or other surface). The base comprises a first leg 156, and a second leg 158. The first leg 156 extends generally forwardly from the first mast 112, and the second leg 158 extends generally forwardly from the second mast 114. A space 160 is defined between the first leg 156 and second leg 158. The space 160, together with the space 124, defines a patient loading zone 162, which facilitates loading and unloading of patients into the patient sling. Particularly, a patient may be positioned between the first and second legs 156, 158, and the first and second masts 112, 114, in the patient loading zone 162. For example, the patient may lie down on the floor in the patient loading zone 162. Due to the spaces 124, 160, the patient may lie down relatively comfortably, for example flat on their back without necessarily having to position their legs around any components of the patient lifting machine 100. The patient sling may then be secured to the patient, and the boom 128 may be raised to lift the patient. In such examples, wherein the first 112 and second 114 masts and first 156 and second 158 legs are spaced apart to define a patient loading zone 162, the patient lifting machine 100 may be referred to as an open base patient lifting machine 100.

Figure 4:
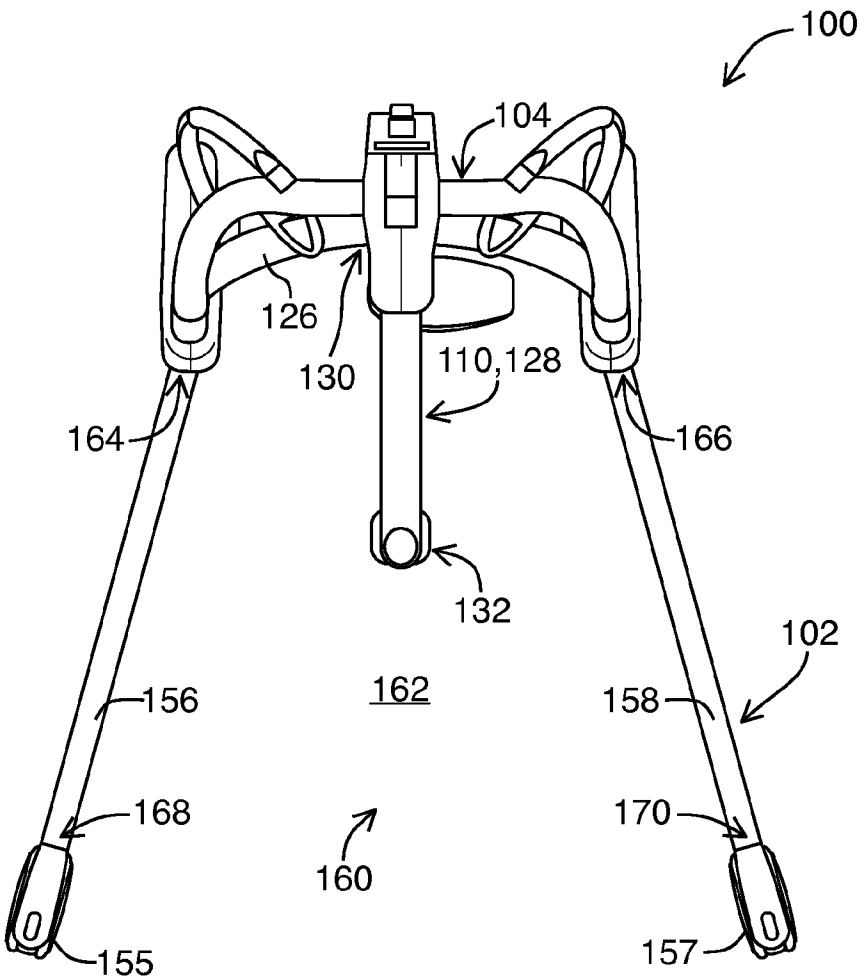
FIG. 4 is a top plan view of the patient lifting machine of FIG. 1, showing first and second legs in a generally opened configuration.
Figure 3:
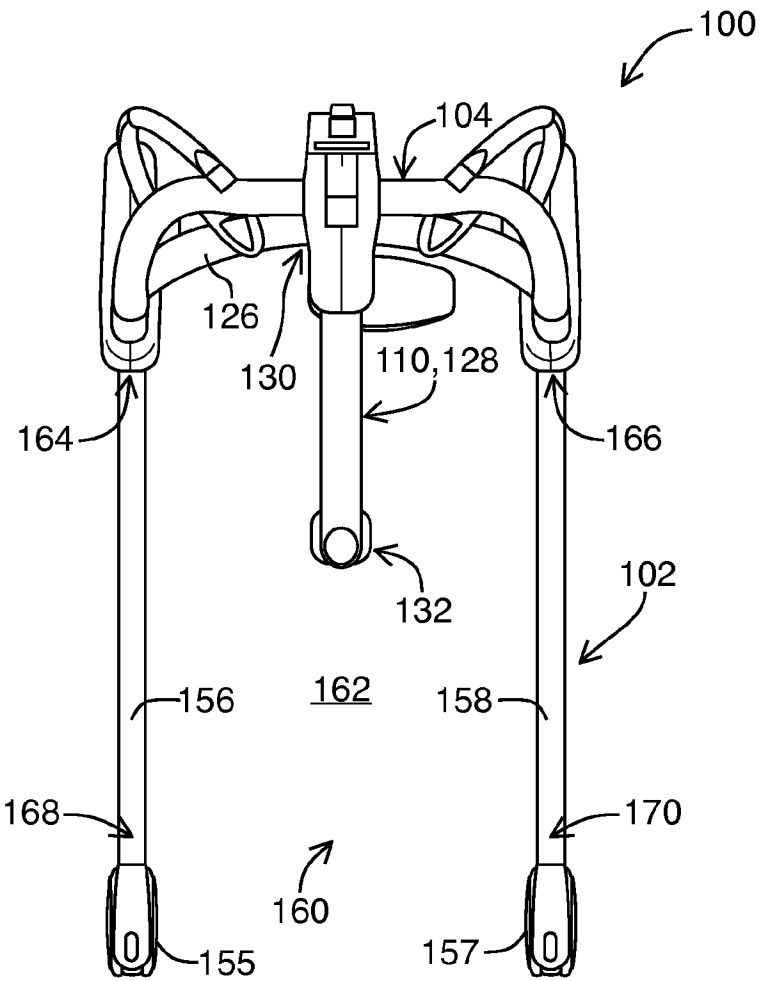
FIG. 3 is a top plan view of the patient lifting machine of FIG. 1, showing first and second legs in a generally straight configuration.

Referring to FIGS. 3 and 4, the first 156 and second 158 legs are rotatable. Particularly, the first leg 156 and second leg 158 each have an inner end portion 164, 166, respectively, coupled to the first 112 and second 114 masts, and an outer end portion 168, 170, respectively, positioned forwardly of the first 112 and second 114 masts. The inner end portion 164 of the first leg 156 is pivotably coupled to the lower end portion 116 of the first mast 112 about a generally vertical first axis 172 (shown in FIG. 5), and the inner end portion 166 of the second leg 158 is pivotably coupled to the lower end portion 118 of the second mast 114 about a generally vertical second axis (not shown). The first 156 and second 158 legs are pivotable about the first 172 and second axes to move the outer end portions 168, 170 towards and away from each other, as shown in FIGS. 3 and 4. By moving the outer end portions 168, 170 away from each other, the size of the patient loading zone 162 is increased. This may be done, for example, to accommodate larger patients, or to accommodate equipment such as wheelchairs.

An actuating assembly for controlling the movement of the first leg 156 will be described below.

Referring back to FIG. 1, a first front wheel 155 is mounted to the outer end portion 168 of the first leg 156, and a second front wheel 157 is mounted to the outer end portion 170 of the second leg 158. The first 155 and second 157 front wheels are configured to engage and roll along the floor both when the base 104 is pushed forwardly or rearwardly along the floor to transport a patient, and when the outer end portions 168, 170 of the first 156 and second legs 158 are moved towards and away from each other. Specifically, in the example shown, the first front wheel 155 and second front wheel 157 are casters.

In alternate examples, the first 155 and second 157 front wheels may not be casters. For example, the first 155 and second 157 front wheels may be wheels that are rotatable about only a single axis, for moving the patient lifting machine 100 along the floor. When the legs 156, 158 are rotated, the first 155 and second 157 wheels may slide along the floor. Alternately, the first 155 and second wheels 157 may be liftable, so that when the legs 156, 158 are rotated, the first 155 and second 157 wheels do not engage the floor.

The manner in which the first leg 156 is pivotably coupled to the first mast 112 will presently be described. The second leg 158 is coupled to the second mast 114 in the same or a similar manner, which will not be described in detail herein.

Figure 5:
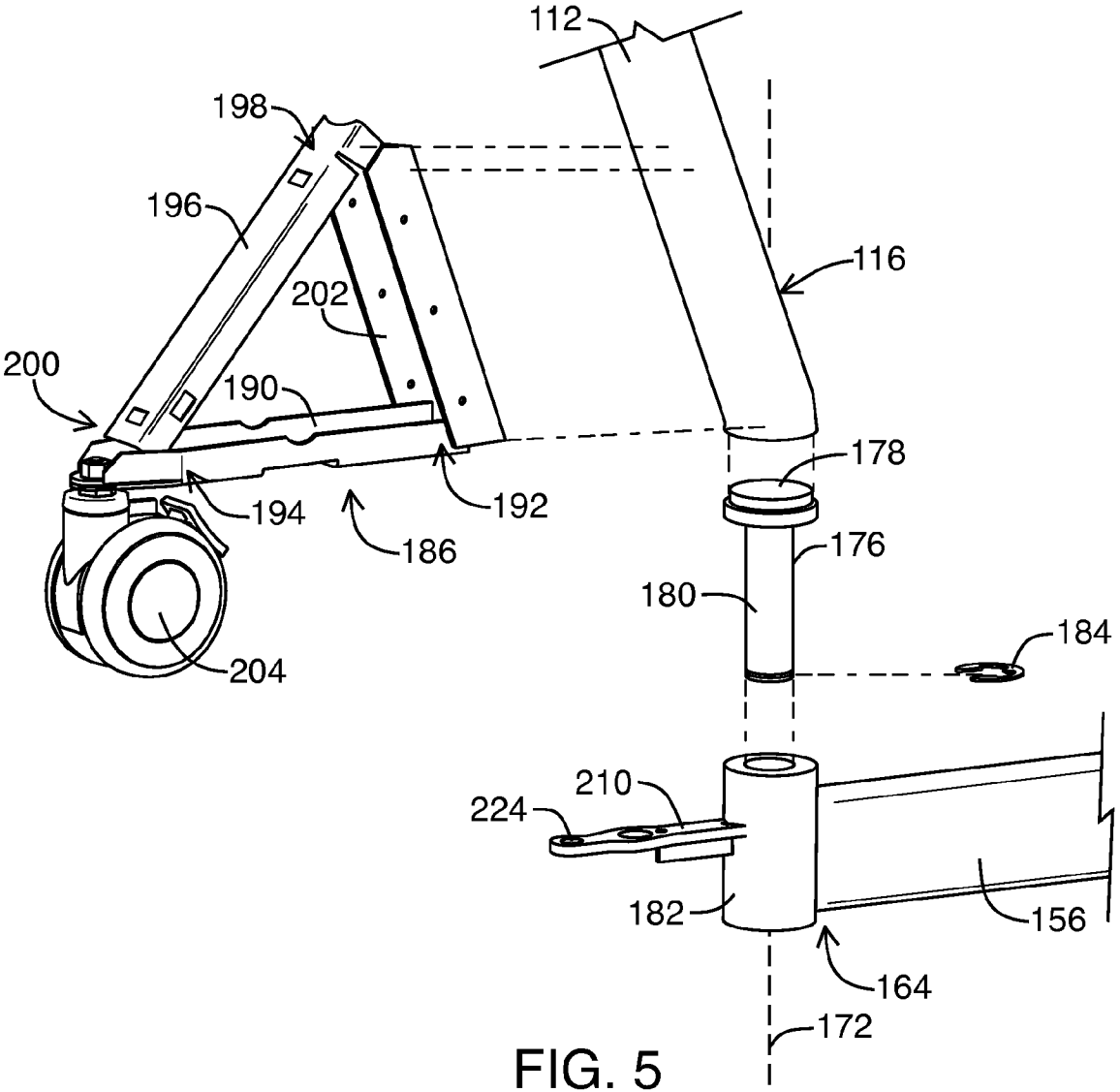
FIG. 5 is a partial perspective exploded view of a leg, mast, and support of the patient lifting machine of FIG. 1, with the covers of the support omitted.

Referring to FIG. 5, the first leg 156 is pivotably connected to the first mast 112 so that the first axis 172 extends through the lower end 116 of the first mast 112. That is, the pivot point of the first leg 156 is directly below the lower end 116 of the first mast 112. The base 102 comprises a first pivot pin 176 which is mounted to the lower end portion 116 of the first mast 112 and positioned beneath the lower end portion 116 of the first mast 112. The inner end portion 164 of the first leg 156 is received on the first pivot pin 176 and is pivotable thereabout.

Specifically, the first pivot pin 176 comprises a boss 178. The lower end portion 116 of the first mast 112 is hollow, and the boss 178 is receivable therein. The boss may be secured in the lower end portion of the first mast 112 by welding, for example. The first pivot pin 176 further comprises a cylindrical body portion 180 extending downwardly from the boss 178. The inner end portion 164 of the first leg 156 includes a generally vertically extending tube 182. The body portion 180 of the first pivot pin 176 is receivable in the tube 182, and is secured therein by a c-clip 184. The first leg 156 may be pivoted by rotating the tube 182 about the body portion 180.

Figure 6:
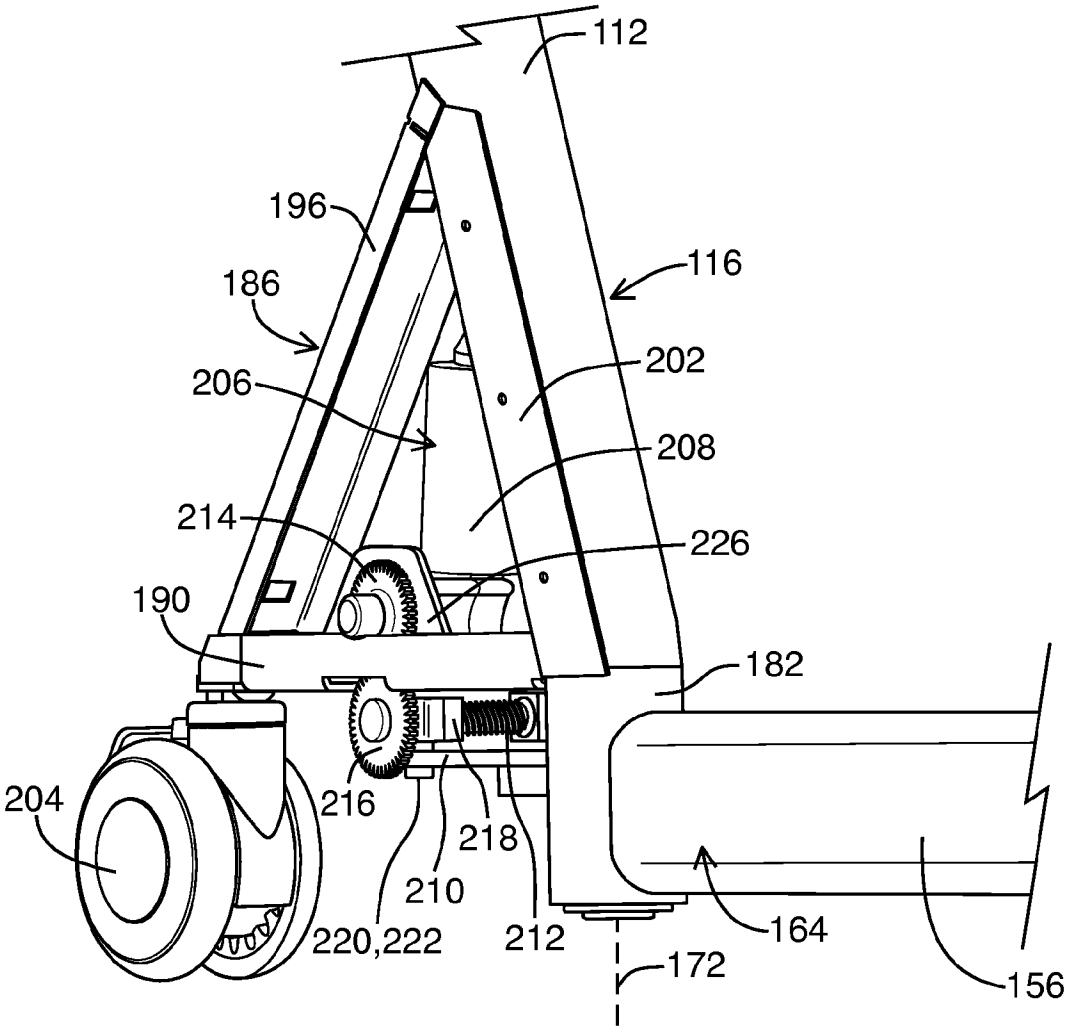
FIG. 6 is a partial perspective illustration of a leg, mast, support and actuating assembly of the patient lifting machine of FIG. 1, with covers of the support omitted.

Referring to FIG. 6, the tube 182 is spaced from the floor. Accordingly, in the example shown, the first 155 and second 157 front wheels are the only ground engaging structures positioned forwardly of the first 112 and second 114 masts.

Referring back to FIG. 1, the patient lifting machine 100 further comprises a first support 186 extending rearwardly of the first mast 112 for engaging the floor rearwardly of the lower end 116 of the first mast 112, and a second support extending 188 rearwardly of the second mast 114 for engaging the floor rearwardly of the lower end portion 118 of the second mast 114. The first 186 and second 188 supports may serve to prevent rearward tipping of the patient lifting machine 100, and also support the patient lifting machine on the floor. The first support 186 will presently be described in detail. The second support 188 may be the same or similar to the first support 186, and will not be described in detail herein.

Referring to FIG. 5, the first support 186 includes a lower strut 190 extending rearwardly from the lower end portion 116 of the first mast 112. The lower strut 190 has a first end portion 192 adjacent the first mast 112 and an opposed second end portion 194. The first support 186 further includes an upper strut 196 extending downwardly and rearwardly from the first mast 112 at a position above the first end portion 192 of the lower strut 190. The upper strut 196 has a first end portion 198 adjacent the first mast 112 and an opposed second end portion 200 joined to the second end portion 194 of the lower strut 190. The first support 186 further includes an inner strut 202 extending between first end portion 192 of the lower strut 190 and the first end portion 198 of the upper strut 196. The lower 190, upper 196, and inner struts 202 are joined to each other by welding, to form a triangle, which is welded to the lower end portion 116 of the first mast 112.

Referring still to FIG. 5, a ground engaging rear wheel 204 is mounted to the second end portion 194 of the lower strut 190. The rear wheel 204 supports the patient lifting machine on the floor, and rolls along the floor when the patient lifting machine 100 is moved to transport a patient. In alternate examples rear wheel 204 may be mounted to another portion of the first support 186, such as to the second end portion 194 of the upper strut 196. In the example shown, the rear wheel s a caster. In alternate examples, another type of wheel other than a caster may be mounted to the first support 186.

Referring back to FIG. 1, the first support 186 comprises a first casing 205, which houses the lower 190, upper 196, and inner 202 struts. The second support 188 comprises a similar second casing 207.

As can be seen in FIGS. 3 and 4, in the example shown, whether the first leg 156 and second leg 158 are in the generally straight configuration or the generally open configuration, the first support 186 and second support 188 remain in generally the same position. That is, they do not pivot inwardly as the first leg 156 and second leg 158 pivot outwardly, and therefore do not decrease the size of the patient loading zone 162.

In alternate examples, the supports 186, 188 may be configured in another manner. For example, a first support may extend rearwadly from the first leg 156, rather than being mounted to the first mast 112. For example, a first support may be integrally formed with or mounted to the tube 182 of the first leg 156.

In yet further alternate examples, the patient lifting machine 100 may not include supports 186, 188. For example, wheels may be mounted to the inner end portions 164, 166 of the legs, to support the base 102 on the floor.

Figure 7:
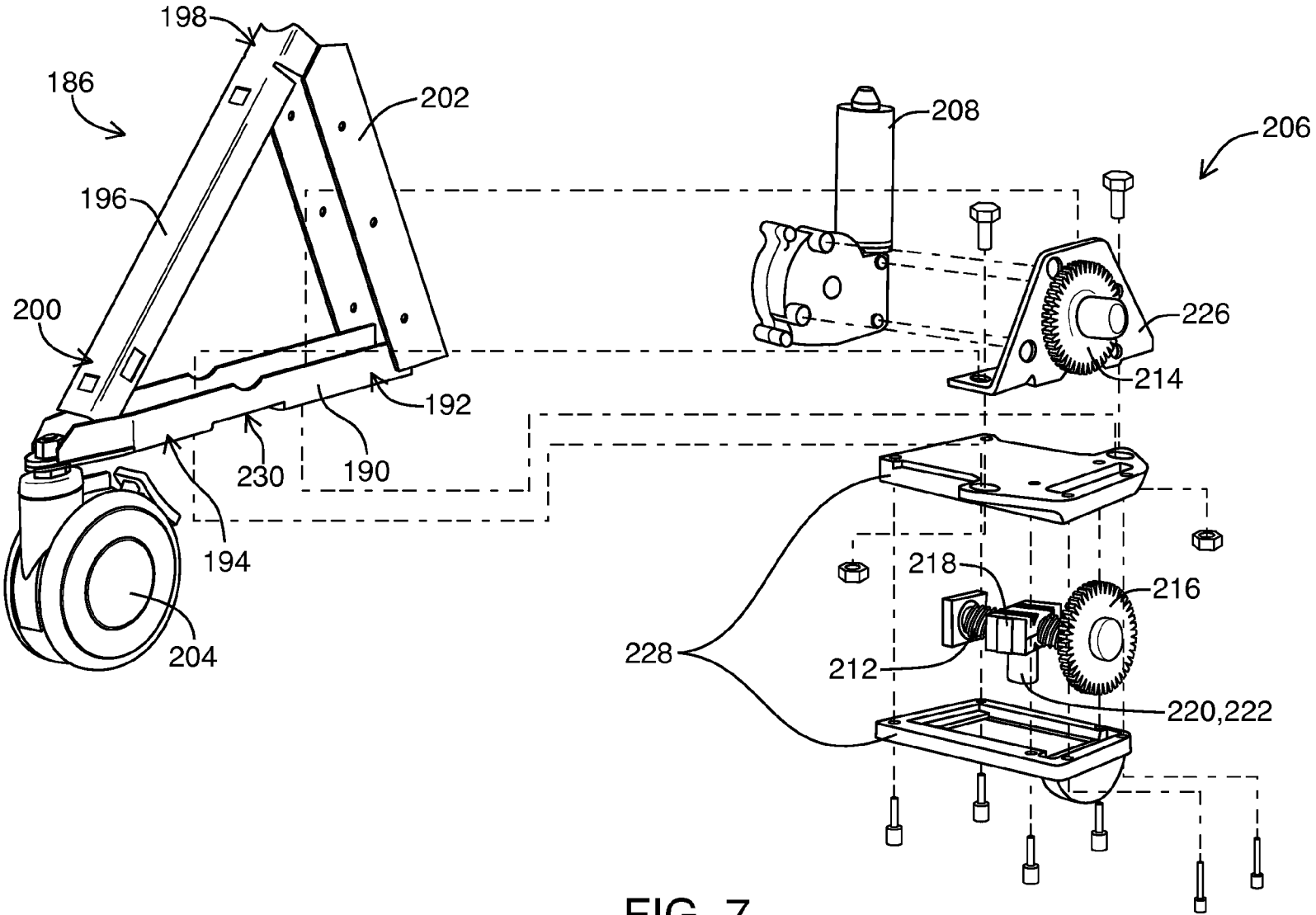
FIG. 7 is a perspective exploded view of the support and actuating assembly of FIG. 6, with covers of the support omitted.

Referring now to FIGS. 6 to 7, a first actuating assembly 206 for controlling the movement of the first leg 156 will be described in detail. A second actuating assembly for controlling the movement of the second leg may be the same as or similar to the first actuating assembly 206, and will not be described in detail herein.

The first actuating assembly 206 is positioned rearwardly of the first mast 112, and comprises a motor 208, which is drivingly connected to the inner end portion 164 of the first leg 156, to move the first leg 156. Specifically, the first actuating assembly 206 comprises an arm 210 (shown most clearly in FIG. 5), which is mounted to the inner end portion 164 of the first leg 156, and extends rearwardly therefrom. In the example shown, the arm 210 is integrally formed with the tube 182, and extends rearwardly therefrom. The first actuating assembly 206 is configured to rotate the arm 210 back and forth about the first axis 172, and thereby rotate the first leg 156 about the first axis 172.

Referring still to FIGS. 6 to 7, in order to drivingly connect the motor 208 to the arm 210, a worm screw 212 is provided. The worm screw 212 extends generally transversely to the arm 210. The worm screw 212 is driven by the motor 208 to rotate the worm screw 212 about its longitudinal axis. Specifically, the motor 208 is drivingly connected to a first gear 214, which is drivingly connected to a second gear 216 mounted about the worm screw 212. The motor rotates the first gear 214, which rotates the second gear 216, which rotates the worm screw.

Referring still to FIGS. 6 to 7, a bracket 218 is mounted to the worm screw 212. The bracket 218 is moveable back and forth along the length of the worm screw 212 in response to rotation of the worm screw 212. A connector 220 connects the bracket 218 to the arm 210. Specifically, the connector 220 comprises a pin 222, which extends downwardly from the bracket 218. The pin 222 is received in an aperture 224 (shown in FIG. 5) of the arm 210, and is secured therein so that the arm 210 is pivotable with respect to the pin 222.

Figure 9:
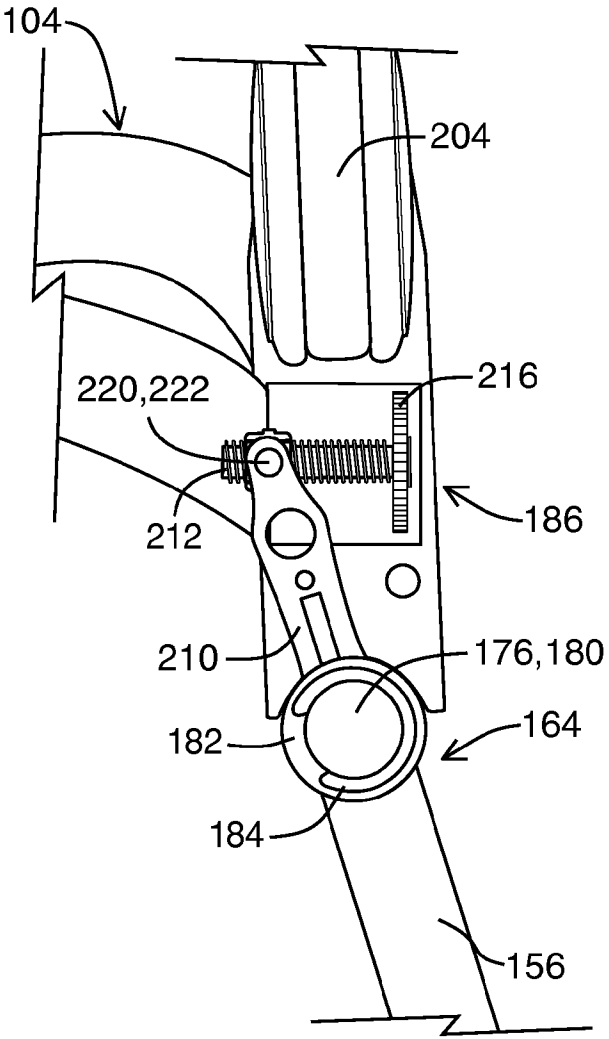
FIG. 9 is a partial bottom plan view of the patient lifting machine of FIG. 1, with the covers removed, showing a leg in a straight configuration with covers of the support omitted.
Figure 8:
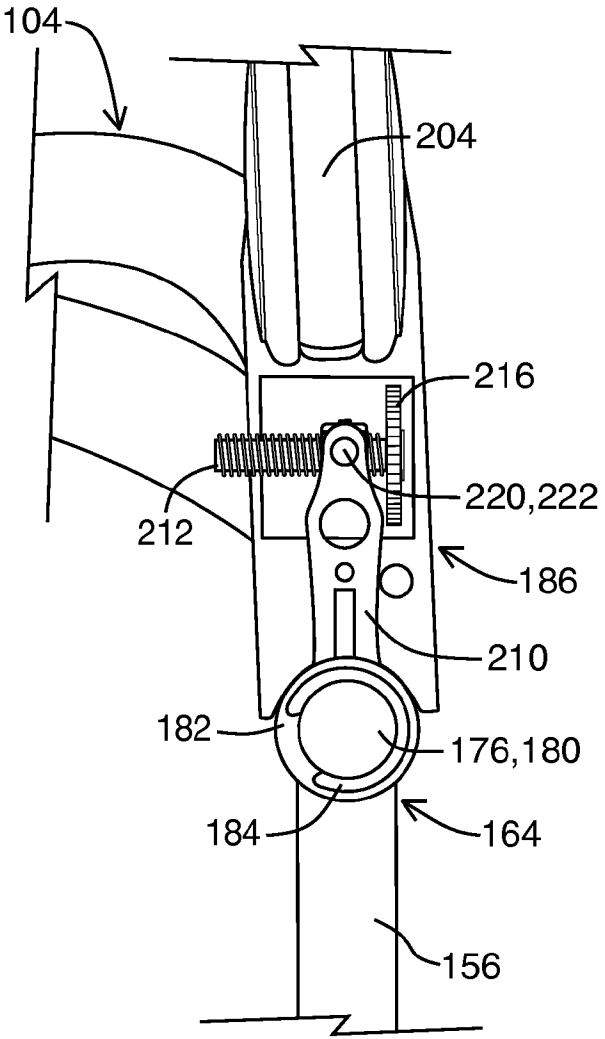
FIG. 8 is a partial bottom plan view of the patient lifting machine of FIG. 1, with the covers removed, showing a leg in a straight configuration with covers of the support omitted.

Referring now to FIG. 8, the leg 156 is shown extending in a generally straight configuration. When the motor 208 is engaged, it will drive the first gear 214, which will drive the second gear 216. The rotation of the second gear 216 will cause the worm screw 212 to rotate, which will cause the bracket 218 to move along the length of the worm screw 212. The movement of the bracket 218 will cause the arm 210 to pivot about the axis 172, which will cause the leg 156 to pivot about the axis 172 to a generally opened configuration, as shown in FIG. 9. In order to move the leg 156 back to the straight configuration, the motor 208 may be engaged in the opposite direction.

The motor 208 may be powered in any suitable manner. For example, a battery (not shown) for the motor 208 may be housed together with the power assembly 154 for the lifting assembly 144. The electrical connections connecting the battery to the motor 208 may be housed within the first mast 112. A switch (not shown) for controlling the motor 208 may be provided in any suitable location on the patient lifting machine 100, such as on the power assembly 154.

Referring back to FIG. 6, in the example shown, the first actuating assembly 206 is mounted to the first support 186.

Specifically, referring to FIG. 7, the motor 208 is mounted to a bracket 226, which is secured on the lower strut 190. The first gear 214 is also secured to the bracket 226. The lower strut has a slot 230 defined therein. The worm screw 212 is rotatably mounted in a casing 228, together with the second gear 216 and the bracket 218. The casing 228 is secured to the lower strut 190 and positioned beneath the lower strut. The second gear 216 engages the first gear 214 through the slot 230. The first actuating assembly 206 is housed within the casing 205, so that it is concealed and protected.

In alternate examples, the first actuating assembly 206 may be configured in another suitable manner.

In the above description, reference has been made to a patient sling which may be suspended from the patient support. It will be appreciated that the patient sling may be of any suitable configuration which allows a patient to be suspended from the patient support.

Various apparatuses or methods were described above to provide an example of each claimed invention. No example described limits any claimed invention and any claimed invention may cover processes or apparatuses that are not described. The claimed inventions are not limited to apparatuses or processes having all of the features of any one apparatus or process described or to features common to multiple or all of the apparatuses described. It is possible that an apparatus or process described is not an embodiment of any claimed invention. Applicant reserves the right to claim such apparatuses or processes in other applications.

We claim:

1. An open base patient lifting machine comprising:

a) a frame comprising a generally upwardly extending first mast and a generally upwardly extending second mast, the frame comprising a lower portion and an opposed upper portion, the first mast and the second mast each comprising a lower end portion at the lower portion of the frame, the lower end portion of the second mast spaced apart from the lower end portion of the first mast to define a space therebetween;

b) a patient support extending forwardly from the upper portion of the frame; and c) a base coupled to the lower portion of the frame and supporting the frame on a floor, the base comprising (i) a first leg extending generally forwardly from the first mast, the first leg comprising an inner end portion pivotably coupled to the lower end portion of first mast about a generally vertical first axis, the first axis extending through the lower end portion of the first mast, and an opposed outer end portion positioned forwardly of the first mast; and (ii) a second leg extending generally forwardly from the second mast, the second leg comprising an inner end portion pivotably coupled to the lower end portion of second mast about a generally vertical second axis, the second axis extending through the lower end portion of second mast, and an opposed outer end portion positioned forwardly of the second mast; the first leg and the second leg pivotable about the first and second axes, respectively, to move the outer end portions of the first and second legs towards and away from each other further comprising a first pivot pin mounted to the lower end portion of the first mast and positioned beneath the lower end portion of the first mast, and a second pivot pin mounted to the lower end portion of the second mast and positioned beneath the lower end portion of the second mast, wherein the inner end portion of the first leg is received on the first pivot pin and is pivotable thereabout, and the inner end portion of the second leg is received on the second pivot pin and is pivotable thereabout further comprising a first actuating assembly and a second actuating assembly for controlling the movement of the first and second legs, respectively, each actuating assembly comprising a motor drivingly connected to the inner end portion of one of the first leg and the second leg;

wherein each actuating assembly further comprises an arm mounted to the inner end portion of one of the first leg and the second leg and extending rearwardly therefrom, and each actuating assembly is configured to rotate a respective one of the arms back and forth about a respective one of the first axis and second axis.

2. The open base patient lifting machine of claim 1, wherein each actuating assembly further comprises:

a) a worm screw extending generally transversely to the arm and driven by the motor to rotate the worm screw about a longitudinal axis thereof;

b) a bracket mounted to the worm screw and movable along the length thereof in response to rotation of the worm screw;

c) and a connector connecting the bracket to the arm.

3. The open base patient lifting machine of claim 2, wherein the first actuating assembly is positioned rearwardly of the first mast, and the second actuating assembly is positioned rearwardly of the second mast.

4. The open base patient lifting machine of claim 1, wherein the first actuating assembly is positioned rearwardly of the first mast, and the second actuating assembly is positioned rearwardly of the second mast.

5. The open base patient lifting machine of claim 1, wherein the patient support comprises a boom comprising a first end portion coupled to the frame, and an opposed second end portion positioned forwardly of the frame and configured to support a patient sling, the second end portion moveable upwardly and downwardly with respect to the frame.

6. The open base patient lifting machine of claim 1, wherein the first mast and second mast each comprise an upper end portion at the upper portion of the frame and opposed to the lower end portions thereof, wherein the upper end portions are joined together.

7. An open base patient lifting machine comprising:

a) a frame comprising a generally upwardly extending first mast and a generally upwardly extending second mast, the frame comprising a lower portion and an opposed upper portion, the first mast and the second mast each comprising a lower end portion at the lower portion of the frame, the lower end portion of the second mast spaced apart from the lower end portion of the first mast to define a space therebetween;

b) a patient support extending forwardly from the upper portion of the frame; and c) a base coupled to the lower portion of the frame and supporting the frame on a floor, the base comprising (i) a first leg extending generally forwardly from the first mast, the first leg comprising an inner end portion pivotably coupled to the lower end portion of first mast about a generally vertical first axis, the first axis extending through the lower end portion of the first mast, and an opposed outer end portion positioned forwardly of the first mast; and (ii) a second leg extending generally forwardly from the second mast, the second leg comprising an inner end portion pivotably coupled to the lower end portion of second mast about a generally vertical second axis, the second axis extending through the lower end portion of second mast, and an opposed outer end portion positioned forwardly of the second mast; the first leg and the second leg pivotable about the first and second axes, respectively, to move the outer end portions of the first and second legs towards and away from each other;

further comprising a first support extending rearwardly of the first mast for engaging the floor rearwardly of the lower end portion of the first mast and a second support extending rearwardly of the second mast for engaging the floor rearwardly of the lower end portion of the second mast;

further comprising a first actuating assembly and a second actuating assembly for controlling the movement of the first and second legs, respectively, each actuating assembly comprising a motor drivingly connected to the inner end portion of one of the first leg and the second leg;

wherein the first actuating assembly is mounted to the first support, and the second actuating assembly is mounted to the second support.

8. The open base patient lifting machine of claim 7, wherein the first support and second support each comprise:

a) a lower strut extending rearwardly from the lower end portion of one of the first mast and the second mast, the lower strut having a first end portion adjacent the one of the first mast and the second mast, and an opposed second end portion;

b) an upper strut extending downwardly and rearwardly from the one of the first mast and the second mast at a position above the first end portion of the lower strut, the upper strut having a first end portion adjacent the one of the first mast and second mast and an opposed second end portion joined to the second end portion of the lower strut.

9. The open base patient lifting machine of claim 7, wherein the patient support comprises a boom comprising a first end portion coupled to the frame, and an opposed second end portion positioned forwardly of the frame and configured to support a patient sling, the second end portion moveable upwardly and downwardly with respect to the frame.

10. The open base patient lifting machine of claim 7, wherein the first mast and second mast each comprise an upper end portion at the upper portion of the frame and opposed to the lower end portions thereof, wherein the upper end portions are joined together.

11. An open base patient lifting machine comprising:

a) a frame comprising a generally upwardly extending first mast and a generally upwardly extending second mast, the frame comprising a lower portion and an opposed upper portion, the first mast and the second mast each comprising a lower end portion at the lower portion of the frame, the lower end portion of the second mast spaced apart from the lower end portion of the first mast to define a space therebetween;

b) a patient support extending forwardly from the upper portion of the frame; and c) a base coupled to the lower portion of the frame and supporting the frame on a floor, the base comprising (i) a first leg extending generally forwardly from the first mast, the first leg comprising an inner end portion pivotably coupled to the lower end portion of first mast about a generally vertical first axis, the first axis extending through the lower end portion of the first mast, and an opposed outer end portion positioned forwardly of the first mast; and (ii) a second leg extending generally forwardly from the second mast, the second leg comprising an inner end portion pivotably coupled to the lower end portion of second mast about a generally vertical second axis, the second axis extending through the lower end portion of second mast, and an opposed outer end portion positioned forwardly of the second mast; the first leg and the second leg pivotable about the first and second axes, respectively, to move the outer end portions of the first and second legs towards and away from each other;

further comprising a first support extending rearwardly of the first mast for engaging the floor rearwardly of the lower end portion of the first mast and a second support extending rearwardly of the second mast for engaging the floor rearwardly of the lower end portion of the second mast;

wherein the first support and second support each comprise:

a) a lower strut extending rearwardly from the lower end portion of one of the first mast and the second mast, the lower strut having a first end portion adjacent the one of the first mast and the second mast, and an opposed second end portion;

b) an upper strut extending downwardly and rearwardly from the one of the first mast and the second mast at a position above the first end portion of the lower strut, the upper strut having a first end portion adjacent the one of the first mast and second mast and an opposed second end portion joined to the second end portion of the lower strut;

further comprising a first actuating assembly and a second actuating assembly for controlling the movement of the first and second legs, respectively, each actuating assembly comprising a motor drivingly connected to the inner end portion of one of the first leg and the second leg;

and further comprising a first casing housing the first actuating assembly and the lower and upper struts of the first support and a second casing housing the second actuating assembly and the lower and upper struts of the second support.

12. The open base patient lifting machine of claim 11, wherein the first support and second support each further comprise a ground engaging rear wheel mounted to the second end portion of one of the lower strut and the upper strut.

13. The open base patient lifting machine of claim 11, further comprising a first front wheel mounted to the outer end portion of the first leg, and a second front wheel mounted to the outer end portion of the second leg.

14. The open base patient lifting machine of claim 13, wherein the first and second front wheels are configured to engage and roll along the floor when the base is pushed forwardly or rearwardly along the floor and when the outer end portions of the first and second legs are moved towards and away from each other.

15. The open base patient lifting machine of claim 13, wherein the first and second front wheels are casters.

16. The open base patient lifting machine of claim 11, wherein the first mast and second mast each comprise an upper end portion at the upper portion of the frame and opposed to the lower end portions thereof, wherein the upper end portions are joined together.

17. The open base patient lifting machine of claim 11, wherein the space extends from the floor upwardly to a position above the lower end portion of the first mast and the lower end portion of the second mast.

18. The open base patient lifting machine of claim 11, wherein the patient support comprises a boom comprising a first end portion coupled to the frame, and an opposed second end portion positioned forwardly of the frame and configured to support a patient sling, the second end portion moveable upwardly and downwardly with respect to the frame.

* * * * *